US006474092B2

(12) United States Patent
Davis

(10) Patent No.: US 6,474,092 B2
(45) Date of Patent: Nov. 5, 2002

(54) APPARATUS AND METHOD FOR A BLOWER COVER

(76) Inventor: Il Yoo Davis, 7945 Audubon Ave. A-6, Alexandria, VA (US) 22306

( * ) Notice: Subject to any disclaimer, the term of this patent is extended or adjusted under 35 U.S.C. 154(b) by 0 days.

(21) Appl. No.: 09/769,297

(22) Filed: Jan. 26, 2001

(65) Prior Publication Data

US 2002/0100289 A1 Aug. 1, 2002

(51) Int. Cl.[7] ..... F25D 17/06
(52) U.S. Cl. ..... 62/419; 62/426; 62/285
(58) Field of Search ..... 62/419, 426, 285

(56) References Cited

U.S. PATENT DOCUMENTS 3,859,816 A * 1/1975 McDonald et al. ..... 62/239
4,416,327 A * 11/1983 Nakada et al. ..... 165/122
4,458,502 A * 7/1984 Adachi et al. ..... 62/259.1
4,702,087 A * 10/1987 Nakajima et al. ..... 62/285
4,974,421 A * 12/1990 Kim ..... 62/272
5,638,693 A * 6/1997 Back ..... 62/262
6,101,829 A * 8/2000 Robinson ..... 62/259.1

FOREIGN PATENT DOCUMENTS

KR 10-1999-0028227 10/1999

* cited by examiner

*Primary Examiner*—William C. Doerrler
*Assistant Examiner*—Mark Shulman
(74) *Attorney, Agent, or Firm*—Bacon & Thomas, PLLC

(57) ABSTRACT

A blower cover and an air conditioner using such blower. A rollable sheet is locked between two side plates by rollable connectors. A belt plate is secured between the side plates to lock the rollable sheet between the side plates. The belt plate also directs air from the blower. The blower cover can easily be assembled at a work site without welding or expert metal working. The blower cover is used in an air conditioner in which air is forced upwards from the blower and the air is directed into a heat exchange unit by one or more air deflectors. Another air deflector directs air coming out of the heat exchanger in an upwardly direction out of the air conditioner and this air deflector also directs any condensate downwards toward a drain system generally located below the heat air conditioner.

20 Claims, 5 Drawing Sheets

APPARATUS AND METHOD FOR A BLOWER COVER

BACKGROUND OF THE INVENTION

1. Field of the Invention

The present invention relates to a method and apparatus for installing a cover for a blower of a heat exchange unit 2. Discussion of the Related Art Prior art covers for the blowers of heat exchange units are generally made of metal stampings that are welded and/or screwed together. Such prior manufacturing methods require expert sheet metal craftsmanship, as well as welding skills. Since such expertise is required, prior art covers or blowers are generally manufactured at a central site. The prior art blower covers are generally manufactured as two or more separate parts that are assembled together after the separate parts of the cover surround a fan/motor unit. Since the prior art blowers are generally manufactured in a separate manufacturing site, rather than at the work site, the bulky blower assembly has to be shipped from the manufacturing site during which the blower cover may be easily damaged.

In addition, since prior art blowers are usually of metal construction, they are susceptible to corrosion caused by moisture and pollutants, thus requiring frequent repairs. In general, prior art blower covers are very costly to manufacture as it requires expert sheet-metal craftsmanship, as well as good welding skills for the manufacture thereof.

In Applicant's Korean Patent Application Number 10-1999-0028227, the document details a blower fan and housing that absorbs and decomposes air pollutants. This document discloses the use of certain materials for the fan and housing of a blower that absorbs or decomposes air pollutants. The Korean 10-1999-0028227 document specifies various types of materials that are suitable for use in a blower and can absorb or degrade air pollutants.

A need exists to dramatically lower the cost of blower covers. A further need exists for blower covers that are resistant to corrosion and can absorb or decompose air pollutants. A further need exists for a blower cover that can be easily assembled at the work site without the requirement for expert knowledge, i.e., sheet-metal and welding skills.

SUMMARY OF THE INVENTION

The present invention provides an apparatus and method for a blower cover of a heat exchange unit. The blower cover includes at least two side plates positioned substantially opposite one another, and a rollable sheet positioned between the two side plates. Two rollable connectors, one for each of the side plates, each including upper and lower walls that are parallel to each other and a rib that connects to and spaces apart the upper and lower walls so that each of the rollable connectors forms a substantially H-shaped cross-section. The upper wall of the rollable connectors include upper left and right legs, and the lower wall includes lower right and left legs. The legs of the rollable connectors are either positioned either to the left or right side of the rib. The upper right leg of the rollable connectors is generally longer than the lower right leg. The upper right leg of the connectors include a lip extension that extends from an open end of the upper right leg perpendicularly downwards, towards the lower right leg to form a substantially L-shaped cavity between the upper and lower right legs and the lip extension. A left cavity is formed by the rib and the upper and lower legs of the rollable connector. The edge portions of each of the side plates is secured in and along the L-shaped cavity of the rollable connectors. The side edges of the rollable sheet are each secured in the left cavities of the rollable connectors.

The blower cover of the present invention solves the various problems associated with prior art blower covers. The apparatus and method of the present invention permits on-site manufacture of the blower covers without the requirement for expert skills.

The blower cover of the present invention can be easily assembled by using rollable components, including the rollable sheet and the rollable connectors for connecting the sheet to the side plates. These components are easily transportable as well since they can be compacted by being rolled or coiled.

BRIEF DESCRIPTION OF THE DRAWINGS

In order more fully explain the features and advantages of the present invention, the following preferred embodiments of a blower cover and assembly in an air conditioning unit are described, as examples only without any limitative character with reference to the accompanying drawings, in which.

DETAILED DESCRIPTION OF THE PREFERRED EMBODIMENTS

Figure 1:
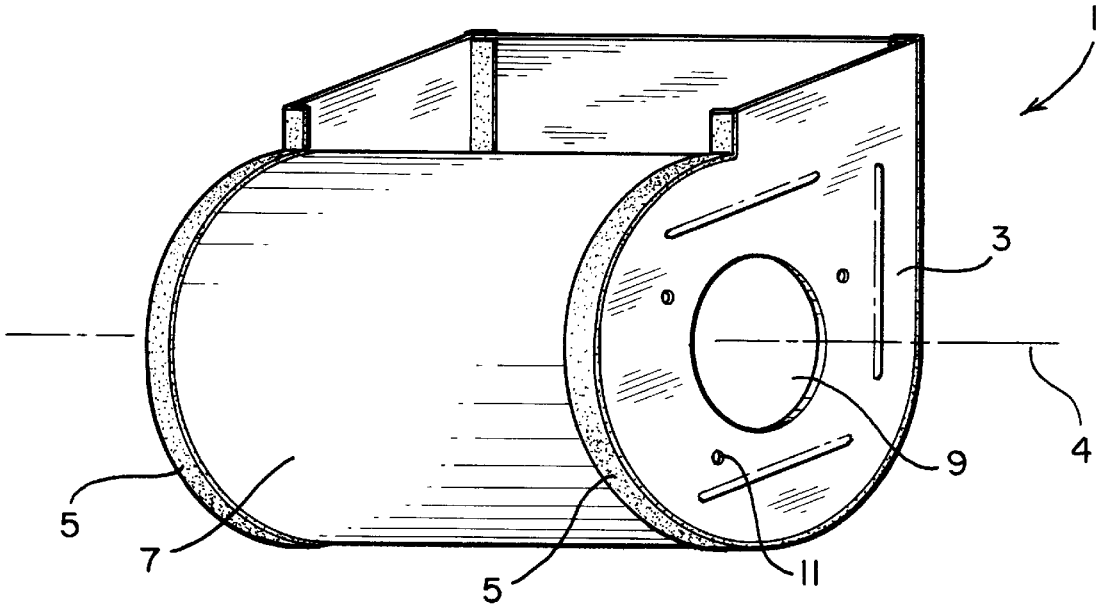
FIG. 1 is a perspective view of the blower cover of the present invention.
Figure 2:
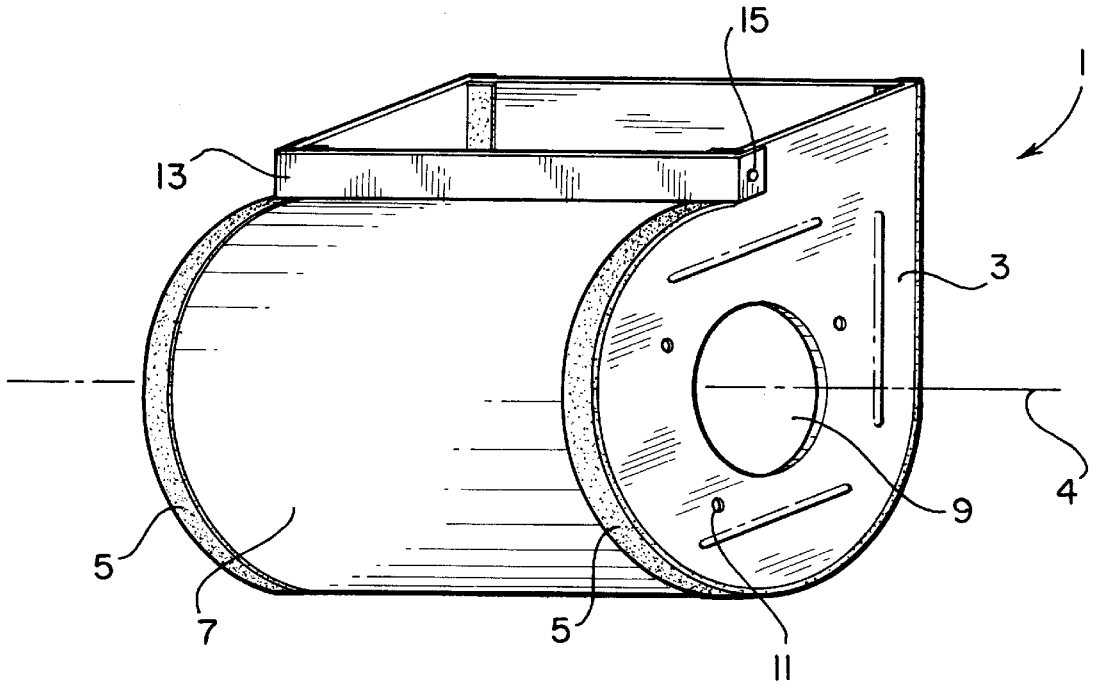
FIG. 2 shows the attachment of an air director plate on the blower shown in FIG. 1.

FIGS. 1 and 2 show perspective views of a blower cover that has been assembled. Two spaced apart side plates 3 are positioned substantially perpendicular to an imaginary longitudinal line 4. The rollable sheet 7 is secured between the two side plates 3 by two rollable connectors 5, each placed between each of the side plates 3 and the rollable sheet 7. The side plates 3 each includes an open cavity 9 through which air is directed into the blower, which includes a motor and fan unit housed within the cover 1. The side plates 3 include small holes through which various attaching devices, including bolts, can be inserted to position the motor and fan unit that is to be housed in the cover 1.

FIG. 2 shows an air deflector plate 13 attached to the side plates 3. The air deflector plate 13 completes an outlet of the cover 1.

Figure 3A:
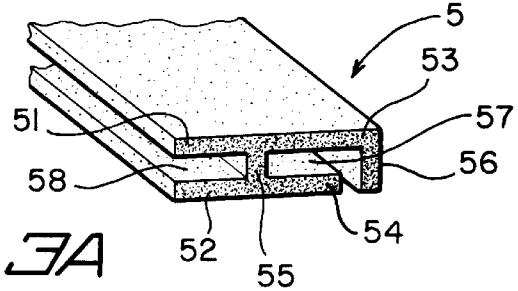
FIGS. 3A–3C show various embodiments of the rollable connector of the present invention.
Figure 3B:
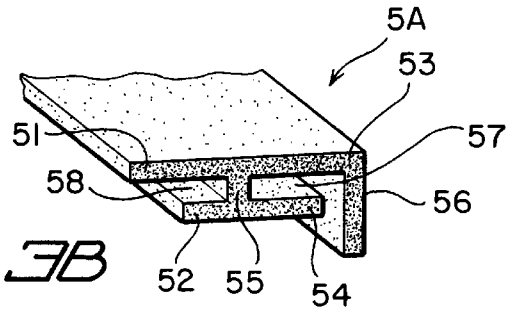
Figure 3C:
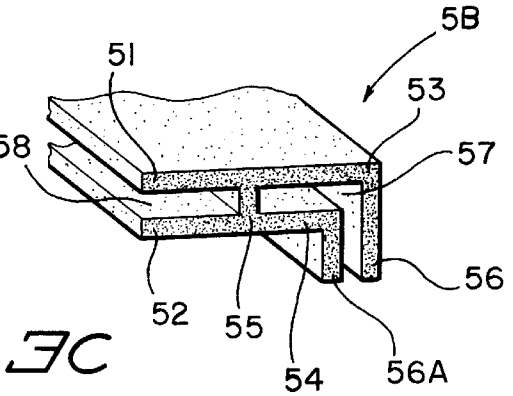

FIGS. 3A–3C show perspective views of various embodiments of the rollable connectors 5, 5A, 5B. Each of the connectors 5, 5A, 5B include upper and lower walls 51–54 that are parallel to each other and a rib 55 that connects to and spaces apart the upper and lower walls 51–54 so that each of the connectors 5, 5A, 5B has a substantially H-shaped cross section. The upper wall includes an upper left leg 51 and upper right leg 53. The lower wall includes a lower right leg 54 and a lower left leg 52. The legs 51–54 are positioned substantially either to the left or right side of the rib 55. The upper right leg 53 is generally longer than the lower right leg 54. The upper right leg 53 includes a lip extension 56 that extends from the open end of the upper right leg 53 perpendicularly downwards towards the lower right leg 54 to form a substantially L-shaped cavity 57 between the upper and lower right legs 53, 54 and the lip extension 56. A left cavity 58 is also formed in the rollable connector 5, 5A, 5B. The left cavity 58 is formed by the rib 55 and the upper and lower left legs 51, 52. FIGS. 3A–3C show various embodiments in which the lengths of the legs 51–54 and the lip extensions 56 vary in length as compared to one another. Further, it is envisioned that the dimensions of the ribs 55 can also be varied in order to accommodate varying dimensions of the side plates 3 and the rollable sheet 7.

FIG. 3C shows a lower lip extension extending from the right leg 54. The lower lip extension 56A is substantially parallel to the lip extension 56 of the upper right leg 53.

Figure 4A:
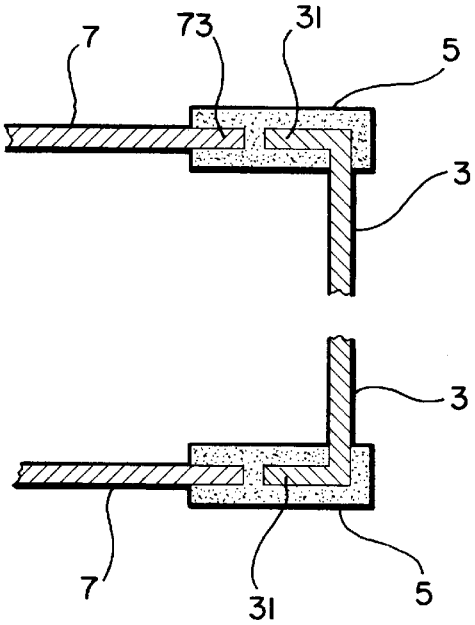
FIGS. 4A–4C show partial cross sections of the assembled blower cover of the invention.
Figure 4B:
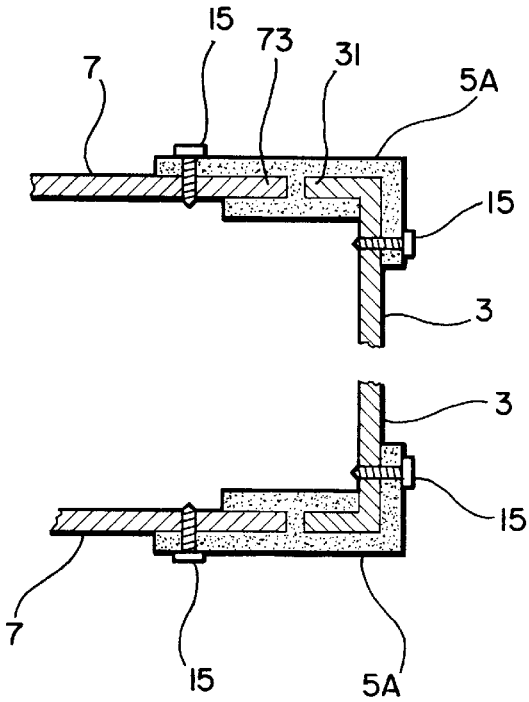
Figure 4C:
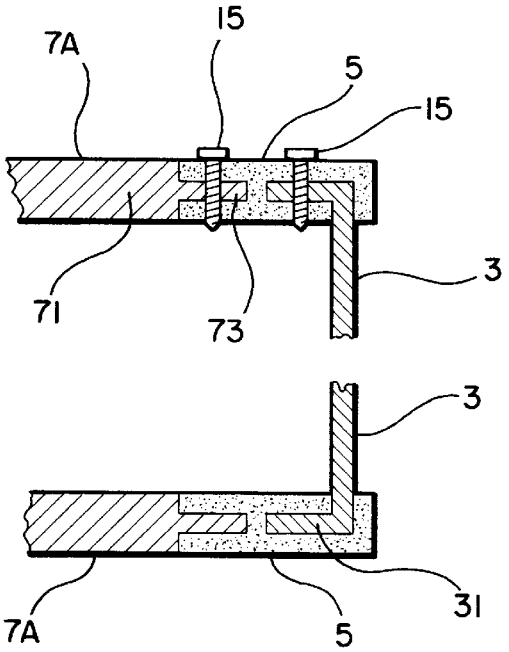

FIGS. 4A–4C illustrate partial cross sections of the various embodiments of the blower cover 1. The side plates 3 are positioned substantially perpendicular to the imaginary longitudinal line 4 (shown in FIG. 1). Each of the plates 3 have an edge portion 31 that are generally positioned on the outer periphery of the side plates 3. The edge portion 31 of the plates that extends substantially parallel to the imaginary longitudinal line 4 and towards the other side plate 3. The rollable connector 5, 5A, 5B is slid along its H-shaped cavity into the side plate 3, such that the L-shaped cavity 57 is filled by the edge portion 31 of the plate 3, along with portions of the outer peripheral of the plate 3, as shown in FIGS. 4A–4C. The rollable sheet 7 includes left and right side edges 73. The right side edge 73 (shown in FIGS. 4A–4C) is inserted into the left cavity 58 of the rollable connector 5, 5A, 5B. The left side of the cover 1 is assembled in the same manner as the right side portion of the cover 1 (as shown in FIGS. 4A–4C).

The assembly of the side plates 3, rollable sheet 7, 7A and the rollable connectors 5, 5A, 5B forms a substantially rigid structure The blower cover can further be strengthened by applying adhesive into the L-shaped cavity and the left cavity of the rollable connectors 5, 5A, 5B in order to bind the components. Alternatively, or in addition to the application of adhesives, securing devices, in the form of screws for example, may secure the side plates 3 to the rollable connector 5, 5A, 5B, and the rollable sheet 7 to the rollable connector 5, 5A, 5B, as well, as shown in FIGS. 4B and 4C.

In FIG. 4C, the rollable sheet 7A includes a central portion 71 and side edges 73. The thickness of the central portion 71 is larger than that for the side edges 73. The rollable sheet 7A is shaped to be flush fit with the left side of the rollable connector 5, as shown in FIG. 4C.

It is preferred that the parts of the blower cover are non-corrosive. The rollable sheet 7, 7A is preferably a plastic, fiberglass or metal sheet that is easily rolled and unrolled for easier transport, and therefore flexible. The side plates 3 are generally made of stamped metal sheets, but it is envisioned that the side plates 3 could just as well be made of injection-molded plastic or fiberglass, or other non-metal material. The rollable connectors 5, 5A, 5B is preferably made of flexible material, such as a plastic or fiberglass compound, which can easily be rolled and unrolled, for easy transportation.

Further, it is known that certain materials (as disclosed in Korean Patent Application 10-1999-0028227) have very good absorption characteristics for absorbing air pollutants. It is preferred that the rollable sheet 7, 7A includes material on its inner surface that faces the fan and motor assembly 9A, to include material having such absorptive characteristics. Material that is suitable for the rollable sheet 7, 7A, to be impregnated on its surface include germanium oxide, silica, alumina, ferrous oxide, calcium oxide, magnesium oxide, potassium oxide, mica, quartz, and zeolite. Similarly, it is also preferable that the rollable connectors 5, 5A, 5B also include such absorptive material in its construction. The material for absorbing air pollutants can also be placed onto the inside surface of the side plates 3 that face the motor and fan assembly 9A. In addition, it is envisioned that the fan blades (not shown) of the fan and motor unit 9A are made of such material that has absorptive characteristics for absorbing air pollutants. It is envisioned that the fan blades of the blower also include such material or materials selected from the group of materials, mentioned in regard to the rollable sheet 7, 7A and rollable connectors 5, 5A, 5B.

Figure 5:
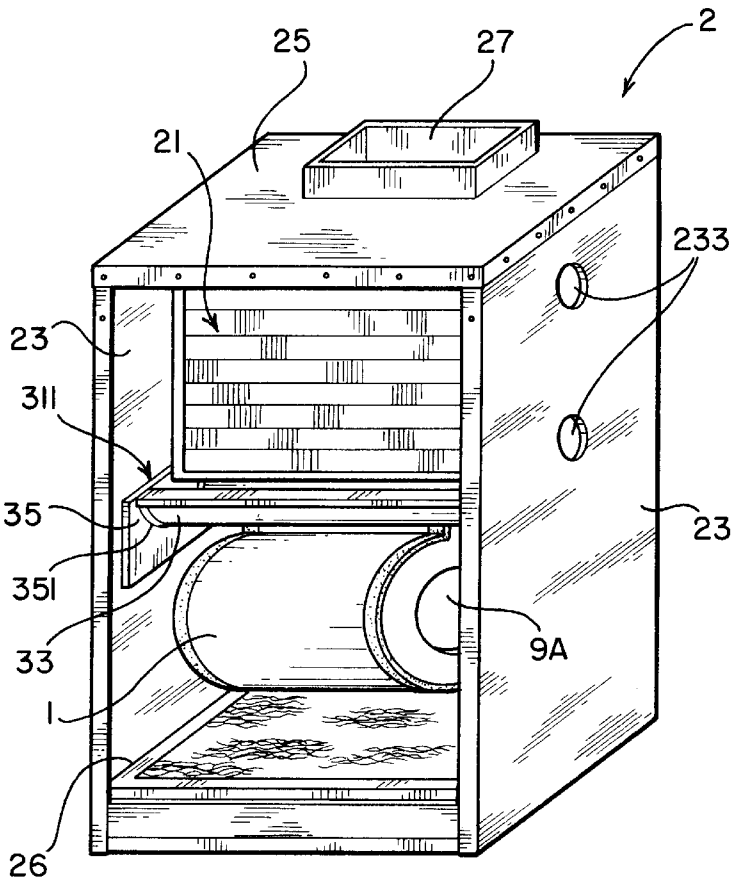
FIG. 5 is a perspective view of the blower cover positioned around a motor and fan unit and secured in an air conditioner unit of the invention.
Figure 7:
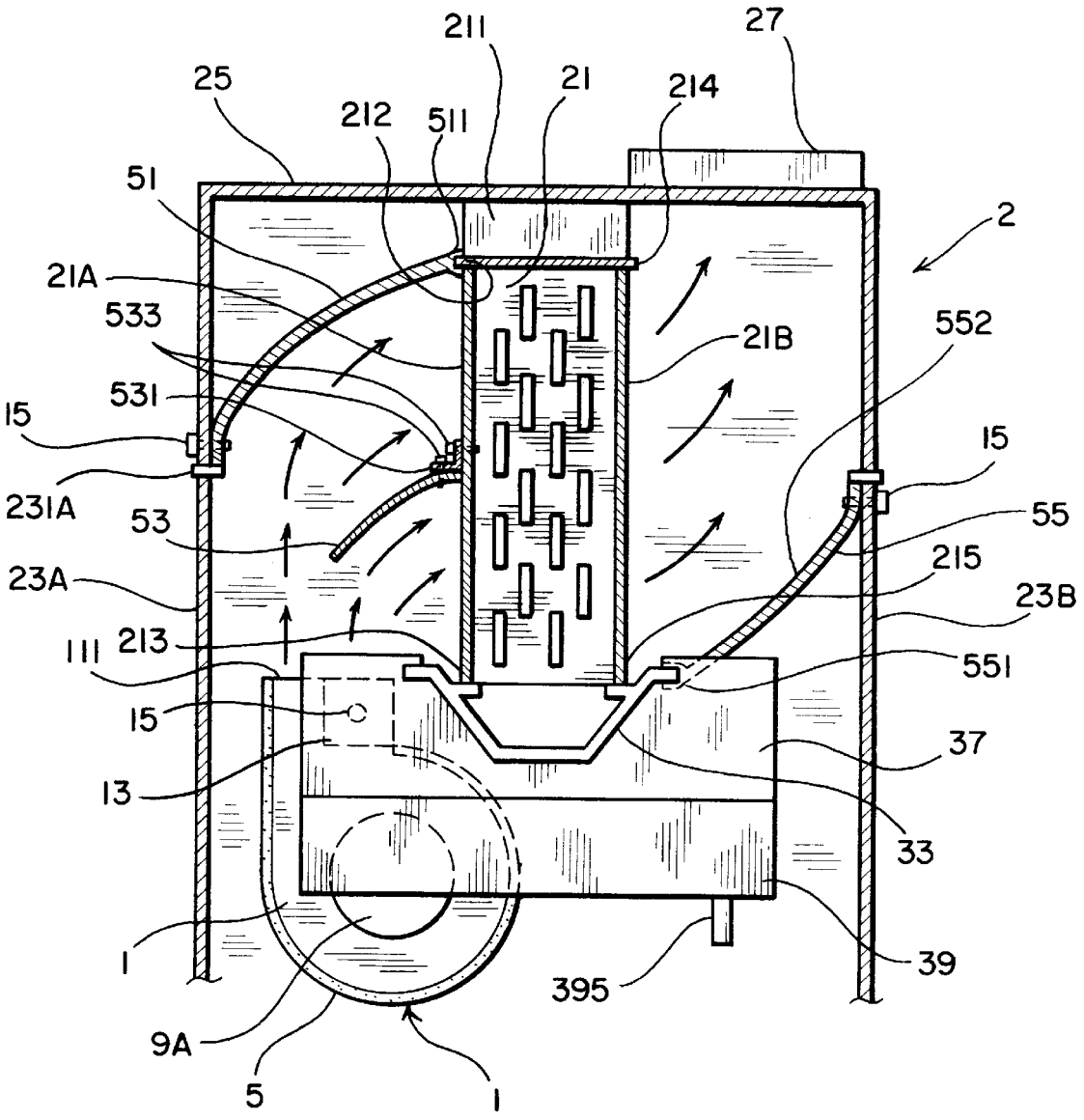
FIG. 7 is a side view of the air conditioner unit of FIG. 5, shown with a wall section removed so that the heat exchanger, water drain system, and the blower are visible.

FIG. 5 shows an air conditioner unit 2 that includes the blower cover 1 secured therein, in addition to a water drainage system 311, as well as a heat exchanger 21. The blower includes a fan and motor unit 9A covered by the cover 1. FIG. 7 illustrates a side view of the air conditioner unit 2 with a side wall removed, so that the flow of air (indicated by the arrows) can be better illustrated. The blower which includes the fan and motor unit 9A covered by the blower cover 1, is positioned to expel air vertically upwards through the outlet 111. A heat exchanger 21 is positioned to the right of the outlet 11 of the blower. The heat exchanger 21 includes both air entering and exiting faces 21A, 21B. Between the two faces of the heat exchanger 21 include passageways (not shown) for the air to travel from the air entering face 21A and out of the air exiting face 21B. Air from the blower is directed into the air entering face 21A of the heat exchanger 21 by the upper and middle air deflectors 51, 53. The air entering and air exiting faces 21A, 21B have upper and lower portions 212–215.

The upper air deflector 51 is attached to the upper portion 212 of the air entering face 21A of the heat exchanger 21. The upper air deflector 51 guides air exiting from the outlet 111 of the blower into the air entering face 21A of the heat exchanger 21.

The lower air deflector 55 is positioned at or near the lower portion 215 of the air exiting face 21B of the heat exchanger 21. The lower air deflector 55 guides air exiting out from the air exiting face 21B of the heat exchanger 21, towards the outlet 27 of the air conditioner unit 2. The lower air deflector 55 includes an upper surface 552 on which condensed water may accumulate. Additionally, water can condense on other parts (including inner surface of side wall 23B) of the air conditioner unit 2, and the lower air deflector 55 is positioned to receive the condensated water and direct the water downwards on its upper surface 552, assisted by gravity. The condensated water is directed from the lower air deflector 55 into a water drain system 31. The water drain system 31 receives the condensed water from the lower air deflector 55 and expels the water via a drain 395.

The middle air deflector 53 is attached between the top and bottom portions 212, 213 of the air entering face 21A of the heat exchanger. The middle air deflector 53 allows for a more even distribution of air from the blower into the air entering face 21A. In the absence of the middle air deflector 53, most of the air exiting the blower would be directed towards the top portion 212 of the air entering face 21A, thus reducing the efficiency of the heat exchanger 21.

The air conditioner unit 2 includes left and right side walls 23A, 23B. The upper air deflector 51 is secured to the left side wall 23A, and the lower air deflector 55 is secured to the right side wall 23B.

Figures 6, 6A:
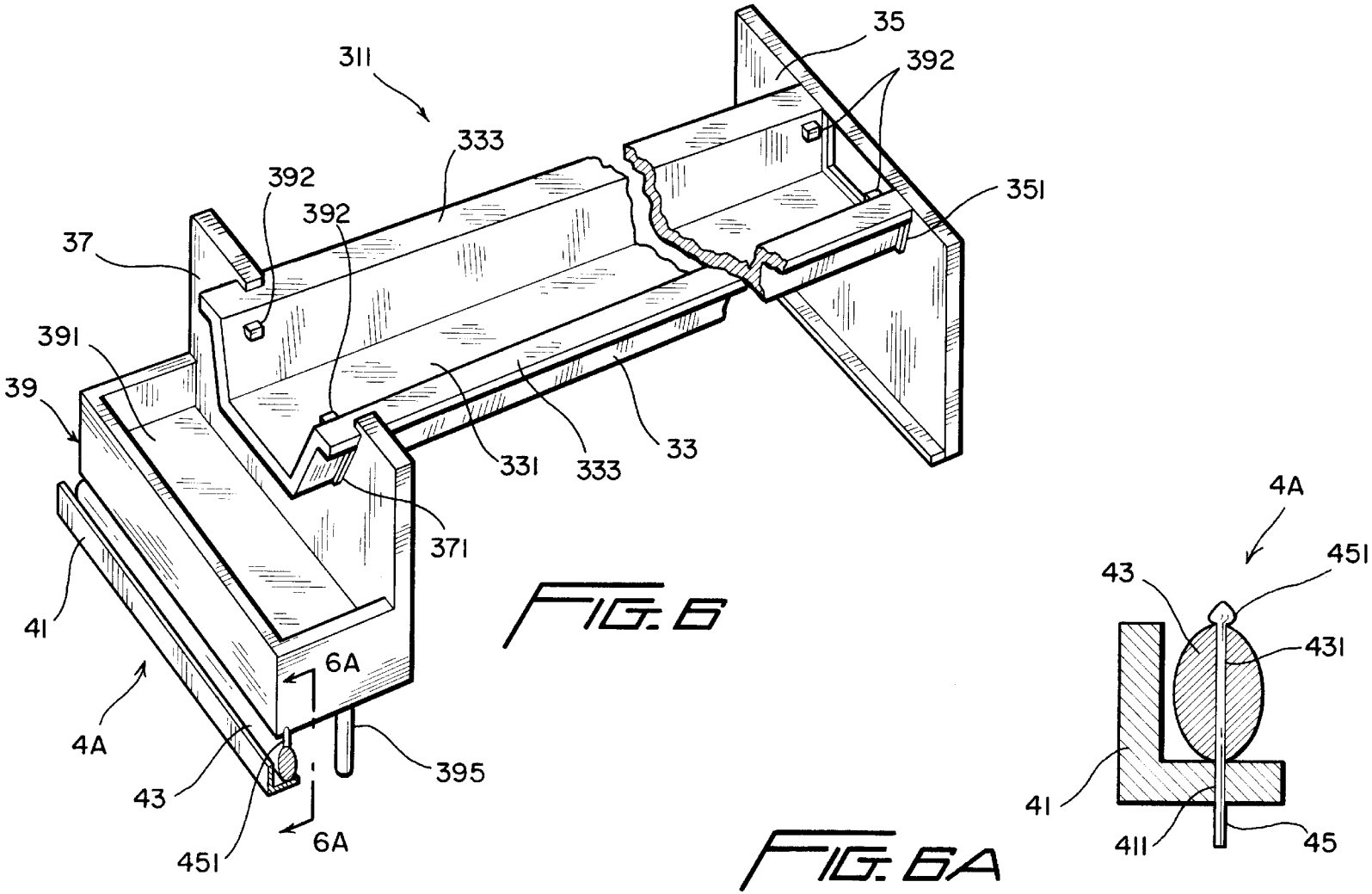
FIG. 6 is a perspective view of a water drain system of the invention.

As shown in FIG. 6 the water drain system 31 includes a pan 33 which is positioned below and along the longitudinal length of the heat exchanger 21. The pan 33 includes lateral projections or heat exchanger supports 392 on which the heat exchanger can be placed, and a bottom 331 which is recessed from the horizontal. Condensed water from the lower air deflector 55 is directed into the bottom 331 of the pan 33. Since the bottom 331 of the pan 33 is recessed, water is directed down along the recessed bottom 331 of the pan 33, into a water collector 39. The water collector 39 is a container having a bottom wall 391 and a drain 395 into which water collected on the bottom wall 391 is directed into. The drain 395 directs water out of the air conditioner device 2.

In one embodiment, the pan 33 may include a lateral lip 333, as shown in FIG. 6, onto which the lower air deflector 55 may be attached to via a connector device 551 which fastens itself onto the lateral lip 333. The lateral lip 333 is preferably recessed from the horizontal in order to direct condensed water from the lower air deflector, over the lateral lip 333 and into the pan 33. FIG. 6 and 6A show a support device 4A for the water collector 39. The support device 4A includes a L-shaped support 41 having a support bore 411 and an elliptical roller 43 having a roller bore 431 rests on the L-shaped support 41. A pin 45 having a pin head with a dimension larger than the roller bore 43 such that when the pin head is caught on the top of the roller bore 431 after the pin 45 penetrates through the roller bore 431 and the support bore 411 to lock the support device 4A in place. To unlock the support device 4A, the pin 45 is removed from the roller 43 and the L-shaped support 41 and the roller 43 is rotated 90 degrees after the water collector 39 is urged upwards.

The present invention is by no means restricted to the above-described preferred embodiments, but covers all variations that might be implemented by using equivalent functional elements or devices that would be apparent to a person skilled in the art, or modifications that fall within the spirit and scope of the appended claims.

I claim:

1. A cover for a blower, the cover comprising:

at least two side plates positioned substantially perpendicular to an imaginary common longitudinal line, each of the plates having an edge portion extending substantially parallel to the imaginary longitudinal line and towards the other plate;

a rollable sheet comprised of a flexible material, the rollable sheet positioned between the two side plates, the sheet comprising left and right side edges;

at least two rollable connectors, one for each of the side plates, each of the connectors comprising upper and lower walls that are parallel and a rib that connects to and spaces apart the walls so that each of the connectors defines a substantially H-shaped cross-section, the upper wall comprising upper left and right legs, the lower wall comprising lower right and left legs, with the legs on either side of the rib, said upper right leg being longer than the lower right leg;

the upper right leg comprising a lip extension that extends from an open end of the upper right leg perpendicularly toward the lower right leg to form a substantially L-shaped cavity between the upper and lower right legs;

a left cavity formed by the rib and the upper and lower left legs; and the edge portions of each of the side plates is secured in and along the L-shaped cavity of a respective one of the rollable connectors, and the side edges of the rollable sheet are each secured in the respective one of the left cavities of the rollable connectors.

2. The cover as recited in claim 1, further comprising a belt plate that extends the length between the two side plates, the belt plate secured to the side plates.

3. The cover as recited in claim 1, wherein a free end of the lower right leg of the rollable connector comprises a lower lip extension that extends parallel to the lip extension of the upper right leg.

4. The cover as recited in claim 1, wherein the rollable sheet further comprises a central portion of uniform thickness and the left and right side edges of the rollable sheet are thinner than the central portion of the rollable sheet.

5. The cover as recited in claim 1, wherein the side plate is further secured inside the L-shaped cavity and the left cavity of the rollable connector by an adhesive.

6. The cover as recited in claim 1, wherein the side plate is further secured inside the L-shaped cavity and the left cavity of the rollable connector by a securing device.

7. The cover as recited in claim 6, wherein the securing device comprises one or more screws that penetrates the side plate and the rollable connector.

8. The cover as recited in claim 1, wherein the cover comprises an absorptive material on its inner surface that absorbs air pollutants.

9. The cover as recited in claim 8, wherein the absorptive material is selected from a group consisting of Germanium Oxide, Silica, Alumina, Ferrous Oxide, Calcium Oxide, Magnesium Oxide, Potassium Oxide, Mica, Quartz, and Zeolite.

10. The cover as recited in claim 1, wherein the rollable sheet and the rollable connectors are comprised of material that is resistant to corrosion.

11. A method of assembling a cover for a blower comprising:

providing a blower having a central axis;

positioning at least two side plates substantially perpendicular to an imaginary longitudinal line that extends through the blower axis, wherein each of the plates having an edge portion extending substantially parallel to the imaginary longitudinal line and towards the other plate;

providing a rollable sheet comprised of a flexible material, the rollable sheet positioned between the two side plates and covering a longitudinal side of the blower, wherein the sheet comprises left and right side edges;

providing at least two rollable connectors, one for each of the side plates, each of the connectors comprising upper and lower walls that are parallel and a rib that connects to and spaces apart the walls so that each of the connectors defines a substantially H-shaped cross-section, the upper wall comprising upper left and right legs, with the lower wall comprising lower right and left legs, with the legs on either side of the rib, said upper right leg being longer than the lower right leg, with the upper right leg comprising a lip extension that extends from an open end of the upper right leg perpendicularly toward the lower right leg to form a substantially L-shaped cavity between the upper and lower right legs, a left cavity formed by the rib and the upper and lower left legs;

securing the edge portions of each of the side plates in and along the L-shaped cavity of a respective one of the rollable connectors;

securing the side edges of the rollable sheet in the respective one of the left cavities of the rollable connectors; and providing a belt plate that extends the length between the two side plates and securing the belt plate to the side plates.

12. An air conditioner and blower comprising:

a blower that forces air upward;

a heat exchanger comprising substantially vertical air entering and air exiting faces, the heat exchanger having air passages between the air entering and the air exiting faces through which air from the blower passes therethrough and is cooled, the air entering and air exiting faces having upper and lower portions;

an upper air deflector attached to the upper portion of the air entering face of the heat exchanger, the upper air deflector guides air from the blower into the air entering face;

a lower air deflector positioned near the lower portion of the air exiting face of the heat exchanger, the lower air deflector guides air exiting out from the air exiting face of the heat exchanger towards an outlet, the lower air deflector comprises an upper surface on which condensed water may accumulate, the lower air deflector arranged so as to guide the condensed water downwards, assisted by gravity; and a water drain system which receives and expels the condensed water that is directed by the lower air deflector.

13. The air conditioner and blower, as recited in claim 12, further comprising a middle air deflector attached between the top and bottom portions of the air entering face of the heat exchanger, the middle air deflector distributes air from the blower into the air entering face evenly.

14. The air conditioner and blower, as recited in claim 12, further comprising left and right side walls, the upper air deflector secured to the left side wall, and the lower air deflector secured to the right side wall.

15. The air conditioner and blower, as recited in claim 12, wherein the water drain system comprises a pan having a bottom positioned below and along the longitudinal length of the heat exchanger, a bottom of the pan includes a recess inclined from the horizontal and directs condensed water down said recess, the water drain system further comprises a water collector on to which the condensed water is directed by the pan, and the water collector comprises a bottom wall having a drain which directs water out of the air conditioner device.

16. The air conditioner and blower, as recited in claim 15, wherein the pan comprises a lateral lip to which the lower air deflector is attached such that condensed water flows from the upper surface of the lower air deflector and over the lateral lip and into the pan.

17. The air conditioner and blower, as recited in claim 12, wherein the blower comprises a fan and motor unit and a cover for the fan and motor unit, the cover comprising an imaginary longitudinal line through the cover;

at least two side plates positioned substantially perpendicular to the imaginary longitudinal line, each of the plates having an edge portion extending substantially parallel to the imaginary longitudinal line and towards the other plate;

a rollable sheet positioned between the two side plates, the sheet comprising left and right side edges;

at least two rollable connectors, one for each of the side plates, each of the connectors comprising upper and lower walls that are parallel and a rib that connects to and spaces apart the walls so that each of the connectors each forms a substantially H-shaped cross-section, the upper wall comprising upper left and right legs, the lower wall comprising lower right and left legs, the legs are either left or right of the rib, the upper right leg is longer than the lower right leg;

the upper right leg comprises a lip extension that extends from an open end of the upper right leg perpendicularly toward the lower right leg to form a substantially L-shaped cavity between the upper and lower right legs;

a left cavity formed by the rib and the upper and lower left legs;

the edge portions of each of the side plates is secured in and along the L-shaped cavity of a respective one of the rollable connectors, and the side edges of the rollable sheet are each secured in the respective one of the left cavities of the rollable connectors; and a belt plate that extends the length between the two side plates and the belt plate secured to the side plates.

18. The air conditioner and blower, as recited in claim 17, wherein the cover or fan comprises material on its inner surface that absorbs air pollutants.

19. The air conditioner and blower as recited in claim 18, wherein the material is selected from a group consisting of Germanium Oxide, Silica, Alumina, Ferrous Oxide, Calcium Oxide, Magnesium Oxide, Potassium Oxide, Mica, Quartz, and Zeolite.

20. The air conditioner and blower, as recited in claim 12, wherein the pan comprises lateral projections on which can support the heat exchanger.

* * * * *